United States Patent [19]

Upchurch et al.

[11] Patent Number: 4,923,010

[45] Date of Patent: May 8, 1990

[54] MUD SOLIDS IMMUNE CLEAN FLUID COMPENSATING SYSTEM

[75] Inventors: James M. Upchurch; Dinesh R. Patel, both of Sugarland, Tex.

[73] Assignee: Schlumberger Technology Corporation, Houston, Tex.

[21] Appl. No.: 414,624

[22] Filed: Sep. 27, 1989

Related U.S. Application Data

[63] Continuation of Ser. No. 292,701, Jan. 3, 1989, abandoned.

[51] Int. Cl.[5] ..... E21B 43/116

[52] U.S. Cl. ..... 166/297; 166/383; 166/55

[58] Field of Search ..... 166/55, 154, 297, 321, 166/383, 177

[56] References Cited

U.S. PATENT DOCUMENTS

| | | | |
|---|---|---|---|
| 4,484,632 | 11/1984 | Vann | 166/297 |
| 4,564,076 | 1/1986 | Vann et al. | 175/4.52 |
| 4,667,735 | 5/1987 | Salerni et al. | 166/55.1 |

*Primary Examiner*—William P. Neuder

*Attorney, Agent, or Firm*—Henry N. Garrana; John H. Bouchard

[57] ABSTRACT

A piston of a well tool is disposed external to a tool housing, and within a space defined by an external sleeve and the housing, and pushes mud solids out of an open end of said space when the piston moves within the space of the tool. Due to the orientation of the tool within the borehole of an oil well, the open end of the space is subject to the force of gravity. Thus, when the piston moves downwardly within the space, mud solids disposed between the piston and the open end of said space are pushed out of the open end in response to the movement of the piston and the force of gravity.

13 Claims, 2 Drawing Sheets

MUD SOLIDS IMMUNE CLEAN FLUID COMPENSATING SYSTEM

This is a continuation of application Ser. No. 07/292,701 filed 01/03/89 now abandoned.

BACKGROUND OF THE INVENTION

The subject matter of the present invention relates to well tools, and more particularly to a mud solids immune clean fluid compensating system for use in such tools.

Downhole well tools typically comprise comparatively intricate flow passages in which operating mechanisms displace working fluids into and out of the tool. During such periods when the working fluids are being displaced into/out of the tools by the operating mechanisms, mud solids enter the tool and clog the operating mechanisms, preventing the mechanisms from displacing the working fluids. As a result, an alternate design is needed to allow the operating mechanisms to perform their displacement functions without also allowing mud-solids to enter the tool and clog the operation of such mechanisms.

SUMMARY OF THE INVENTION

Accordingly, it is a primary object of the present invention to design a mud solids immune clean fluid compensating system for use with a well tool which will allow the operating mechanism of such tool to displace working fluid into and out of the tool without simultaneously allowing mud solids to enter such tool and clog the functioning of the operating mechanism.

In accordance with these and other objects of the present invention, an operating piston is relocated to a position external to the tool housing, and a piston sleeve is mounted around the piston, one end of the piston sleeve overlapping the piston by a predetermined amount thereby forming an open-ended cavity bounded on three sides by the piston, the piston sleeve, and the tool housing. Working fluid is disposed within the tool and is displaced through intricate flow passages within the tool when the piston moves relative to the tool housing. Mud solids enter the open-ended cavity when the piston moves; however, since the cavity is open-ended, that is, bounded on three sides only, the mud solids fall out of the open end portion of the cavity in response to either or both of the force of gravity and a downward movement of the piston, thereby preventing the operating mechanisms within the tool from becoming clogged and inoperative.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DESCRIPTION OF THE PREFERRED EMBODIMENT

Figure 1A:
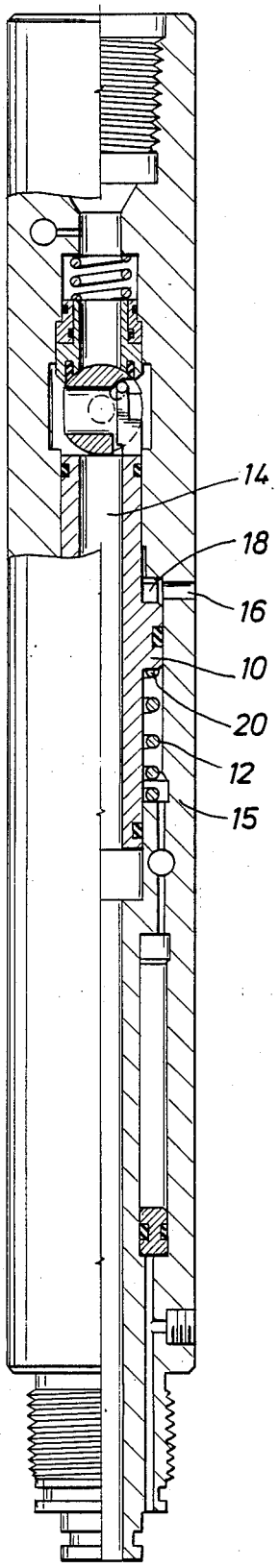
FIG. 1A (PRIOR ART)
FIGS. 1a–1b illustrate prior art well tools wherein a piston was located internal to a tool housing thereby allowing mud solids to enter the housing when the piston moves relative to the housing while displacing working fluids.
Figure 1B:
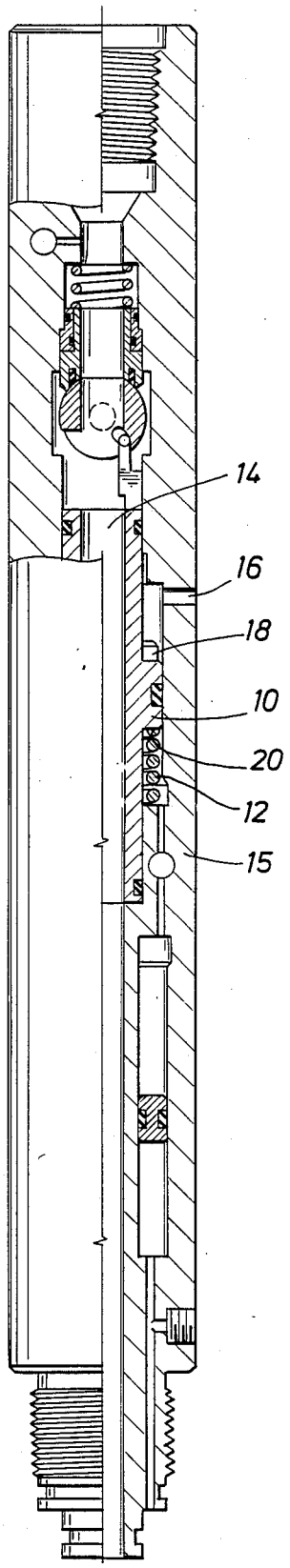
FIG. 1B (PRIOR ART)

Referring to FIGS. 1a to 1b, a prior art well tool is illustrated.

In FIG. 1a, a piston 10 is biased against a spring 12 and is movable within a chamber 14 bounded by a housing 15. A working fluid enters channel 16 and applies a pressure against a working surface 18 of the piston 10. If the hydrostatic pressure of the working fluid against the working surface 18 of piston 10 is greater than the pressure of the spring 12 against an opposite surface 20 of piston 10, the piston 10 moves downwardly, as shown in the drawings of FIGS. 1a and 1b.

Very often, mud solids exist in a borehole when the tool of FIGS. 1a and 1b is disposed downhole in the borehole. Because the piston 10 is disposed internally to the housing 15, when the piston 10 moves downwardly as shown in FIG. 1b, mud solids enter the channel 16 and rest against the working surface 18 of piston 10. When the piston attempts to move upwardly in response to the bias force of spring 12, as shown in FIG. 1a, the mud solids on the working surface 18 of piston 10 block the upward movement of piston 10 and thereby clog the operation of piston 10 when moving upwardly in chamber 14. As a result, the well tool of FIGS. 1a and 1b must be re-designed to avoid the clogging problem.

Figure 2A:
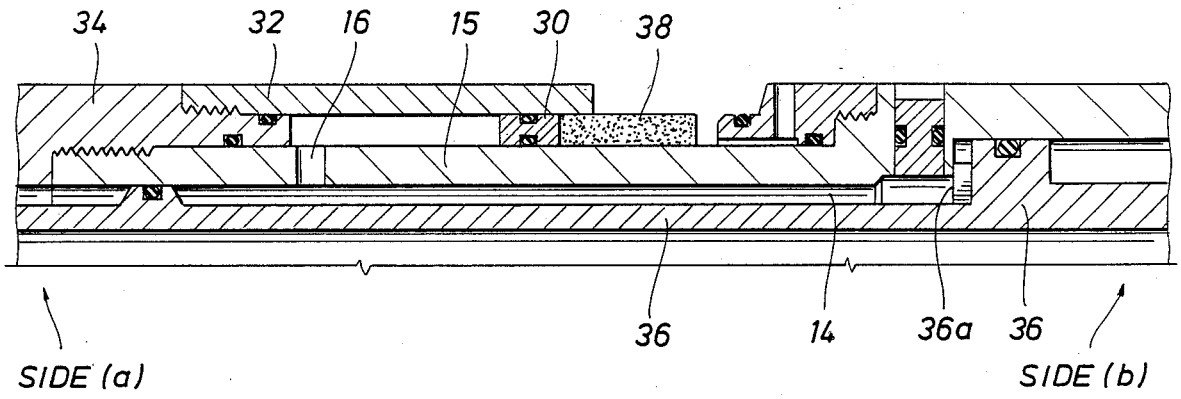
FIGS. 2a–2b illustrate the well tool design of the present invention wherein the piston is relocated to a position external to the tool housing.
Figure 2B:
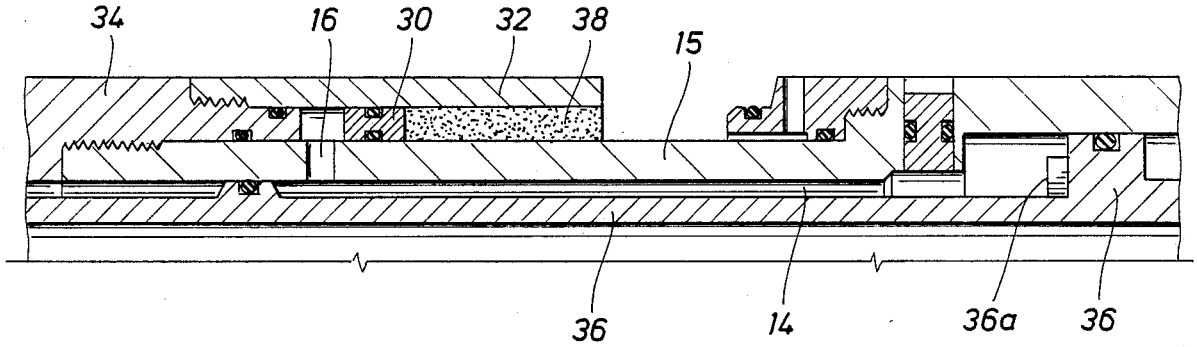

Referring to FIGS. 2a–2b, a well tool in accordance with the present invention is illustrated.

In FIGS. 2a–2b, the well tool comprises a piston 30 which is disposed externally to the housing 15, but internally to a piston sleeve 32. The piston 30 is bounded on three sides by housing 15, piston sleeve 32, and a portion 34 of the tool. A mandrel 36 is disposed inside the tool, defining a chamber 14 between the housing 15 and mandrel 36. The mandrel 36 is adapted to moves along a longitudinal axis of the tool in response to fluid pressure placed on surface 36a of mandrel 36. Since the piston 30 is not bounded on a fourth side, the piston 30 is disposed in an open-ended cavity joined by three wall surfaces consisting of housing 15, piston sleeve 32, and the portion 34 of the tool. The piston 30 communicates with chamber 14 via a channel 16. A working fluid is disposed in channel 16 and chamber 14. The piston 30 is adapted for moving within the open-ended cavity joined by the said three wall surfaces (15, 32, and 34). The tool of FIGS. 2a and 2b has a side (a), and a side (b), side (a) being disposed above side (b) in the borehole of an oil well. In FIG. 2b, mud solids 38 are disposed in the open-ended cavity.

In operation, referring to FIGS. 2a and 2b of the drawings, the tool of FIGS. 2a and 2b is disposed in the borehole of an oil well with side (a) of the tool being disposed above side (b) of the tool in the borehole. As a result, the open-end of the open-ended cavity on the tool, formed of the housing 15, the piston sleeve 32, and the tool portion 34, faces downwardly, into the borehole. When the piston 30, of FIG. 2*a*, moves from right to left in the figure, working fluid in channel 16 is displaced into chamber 14. A mandrel 36 begins to move in response to displacement of the working fluid from channel 16 into chamber 14. As shown in FIG. 2*b*, mandrel 36 has moved (from left to right) in response to movement of piston 30. However, as shown in FIG. 2*b*, mud solids 38 have entered the open-ended cavity bounded by piston sleeve 32, tool portion 34, and housing 15. Since the side (b) of the tool is disposed below side (a) of the tool, when the piston 30 moves in the opposite direction, from left to right as shown in FIG. 2*a*, the piston 30 pushes the mud solids 38 out of the open-ended cavity. The mud solids 38 exit the open-ended cavity in response to movement of piston 30 and in response to the downward force of gravity on the mud solids 38. Therefore, since the piston 30 is disposed external to the housing 15 of the tool (in lieu of internally, as in the prior art tool) and within an open-ended cavity, the contents of which are responsive to the downward force of gravity, the mud solids do not clog the operation of piston 30 when such piston 30 moves down and up in the borehole (left and right in the drawing figures), while displacing the working fluids within the channel 16 and chamber 14 of the tool.

The invention being thus described, it will be obvious that the same may be varied in many ways. Such variations are not to be regarded as a departure from the spirit and scope of the invention, and all such modifications as would be obvious to one skilled in the are intended to be included within the scope of the following claims.

I claim:

1. A well tool, comprising:

a housing defining an internal chamber;

a channel disposed transversely through a portion of said housing;

a sleeve disposed around said housing and enclosing said channel thereby defining an annular space between the sleeve and the housing, one end of said annular space communicating with said channel, the other end of said annular space being completely open;

a piston disposed in said annular space; and a working fluid disposed in a cavity formed by said chamber, said channel and one portion of said annular space between said piston and said one end of said annular space, said piston being adapted to move within said annular space thereby moving said working fluid in said cavity, the other portion of said annular space between said piston and said other end of said annular space being bounded solely by three sides and being adapted to contain particulate matter, said three sides being said housing, said piston, and said sleeve, the piston pushing substantially all of said particulate matter out of the completely open end of said annular space when said piston moves toward said completely open end of said annular space.

2. The well tool of claim 1, further comprising:

a mandrel disposed within the housing of said tool and defining said internal chamber between said housing and said mandrel, said mandrel being adapted to move longitudinally within said tool.

3. The well tool of claim 2, wherein said working fluid moves said mandrel when said piston moves within said annular space.

4. A method of operating a well tool while preventing said tool from being clogged by particulate matter which enters said tool during operation thereof, said tool including a piston disposed externally to a housing of said tool, said piston being adapted to move longitudinally relative to the tool housing and a piston sleeve disposed externally to said piston so as to define an open-ended cavity bounded solely by three sides, said three sides being said piston sleeve, said piston and said housing of said tool, said open-ended cavity being adapted to contain said particulate matter, a fourth side of said open-ended cavity being completely open, comprising the steps of:

moving said piston toward said fourth side of said open-end cavity; and pushing substantially all of said particulate matter out of said fourth side of said open-ended cavity when said particulate matter is disposed therein.

5. The method of claim 4, wherein said tool includes a mandrel disposed within said housing and adapted to move longitudinally along a longitudinal axis of said tool, said mandrel and said housing defining a chamber, said housing including a channel communicating with said chamber, and a working fluid disposed within said chamber and said channel, comprising the steps of:

moving said piston away from said fourth side of said open-ended cavity; and pushing said working fluid against a portion of said mandrel thereby moving said mandrel longitudinally along said longitudinal axis of said tool.

6. A well tool comprising:

a housing;

a sleeve; and a piston disposed between and in contact with said housing and said sleeve thereby defining an annular space bounded solely by three sides, said three sides being said housing, said piston, and said sleeve, a fourth side of said annular space being completely open, said annular space being adapted to contain particulate matter, said piston pushing substantially all of said particulate matter out of the completely open fourth side of said annular space when said piston moves toward said fourth side.

7. The well tool of claim 6, further comprising:

a mandrel disposed within said housing, a chamber being defined between said mandrel and said housing.

8. The well tool of claim 7, further comprising a tool portion disposed between and in contact with said housing and said sleeve thereby defining a further annular space bounded on four sides by said housing, said tool portion, said sleeve, and said piston.

9. The well tool of claim 8, wherein said housing comprises a channel communicating with said chamber and said further annular space.

10. The well tool of claim 9, further comprising:

a working fluid disposed within said chamber, said channel, and said further annular space.

11. The well tool of claim 10, wherein said piston moves said working fluid and said working fluid moves said mandrel when said piston moves away from said fourth side of said annular space.

12. A method of operating a well tool including a housing, a sleeve, and a piston disposed between and in contact with said housing and said sleeve thereby defining an annular space bounded solely by three sides, said three sides being said housing, said piston, and said sleeve, said piston adapted to move along a longitudinal axis of said tool, said annular space adapted to contain particulate matter, comprising the steps of:

moving said piston along said longitudinal axis of said tool; and pushing substantially all of said particulate matter out of said annular space when said particulate matter is disposed therein.

13. The method of claim 12, wherein a fourth side of said annular space is completely open, the particulate matter being pushed out of the completely open fourth side of said annular space by said piston during the pushing step.

* * * * *